United States Patent [19]

Phillips

[11] 4,079,473

[45] Mar. 21, 1978

[54] WATER BED MATTRESS HAVING A FLUID SUPPORT MEMBER

[76] Inventor: Raymond M. Phillips, 2566 S. Tuna Canyon Rd., Malibu, Calif. 90265

[21] Appl. No.: 749,407

[22] Filed: Dec. 10, 1976

Related U.S. Application Data

[63] Continuation-in-part of Ser. No. 623,445, Oct. 17, 1975, which is a continuation-in-part of Ser. No. 581,262, May 27, 1975, Pat. No. 4,006,501.

[51] Int. Cl.[2] ..... A47C 27/08

[52] U.S. Cl. ..... 5/367; 5/371; 178/376

[58] Field of Search ..... 5/365, 367, 349, 370, 5/371

[56] References Cited

U.S. PATENT DOCUMENTS

| | | | |
|---|---|---|---|
| 3,748,669 | 7/1973 | Warner | 5/367 |
| 3,810,265 | 5/1974 | McGrew | 5/367 |
| 3,840,920 | 10/1974 | Voelker | 5/367 |
| 3,918,110 | 11/1975 | Cantello et al. | 5/371 |
| 3,925,835 | 12/1975 | Pennington et al. | 5/371 |
| 3,983,587 | 10/1976 | Gorran | 5/371 |
| 4,006,501 | 2/1977 | Phillips | 5/371 |

*Primary Examiner*—Casmir A. Nunberg
*Attorney, Agent, or Firm*—Robert J. Schaap

[57] ABSTRACT

A mattress construction having a liquid containing chamber formed by an upper sheet, a lower sheet and a peripherally extending side wall and which liquid containing chamber may be filled with water or similar liquid. A material filled cylinder, which may constitute an air chamber, is located along the peripheral portion of the liquid containing chamber. When the mattress construction is disposed within a frame, the peripheral material filled cylinder surrounds the peripheral portions of the lower sheet forming the water chamber in registry with the peripherally extending side wall and provides support thereto. Thus, the upper sheet of the mattress construction is substantially supported by liquid within the liquid chamber to support an individual lying thereon. Moreover, rigid peripheral support is provided by the material filled cylinder which surrounds the periphery of the water chamber. The present invention also provides a unique method of making the mattress constructions of the present invention.

32 Claims, 29 Drawing Figures

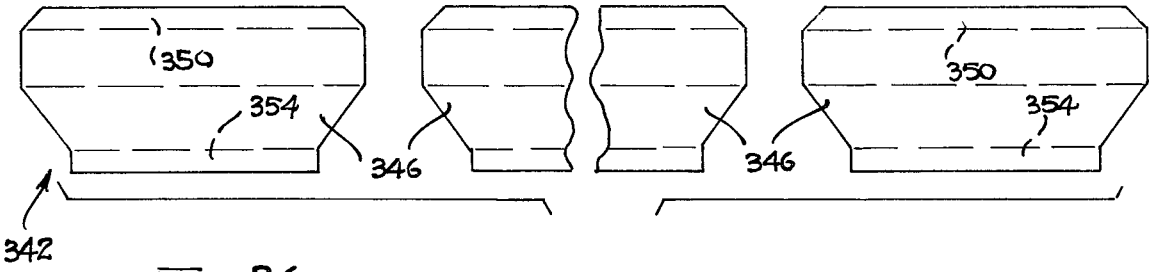
FIG. 26
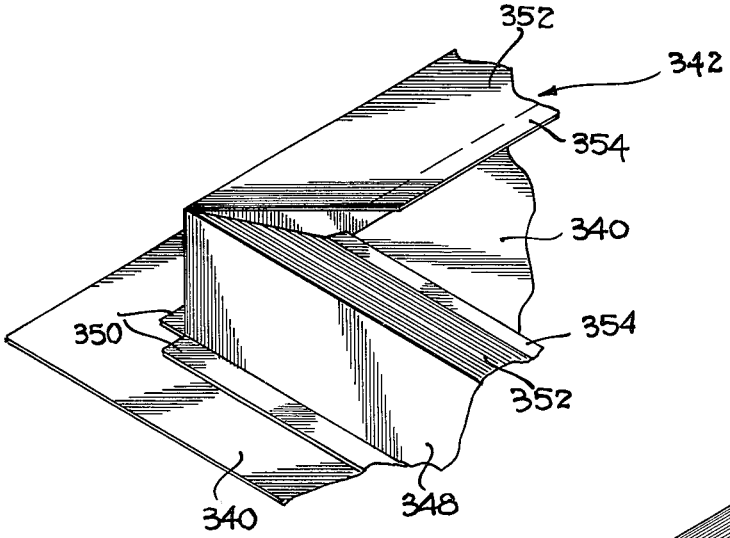
FIG. 27
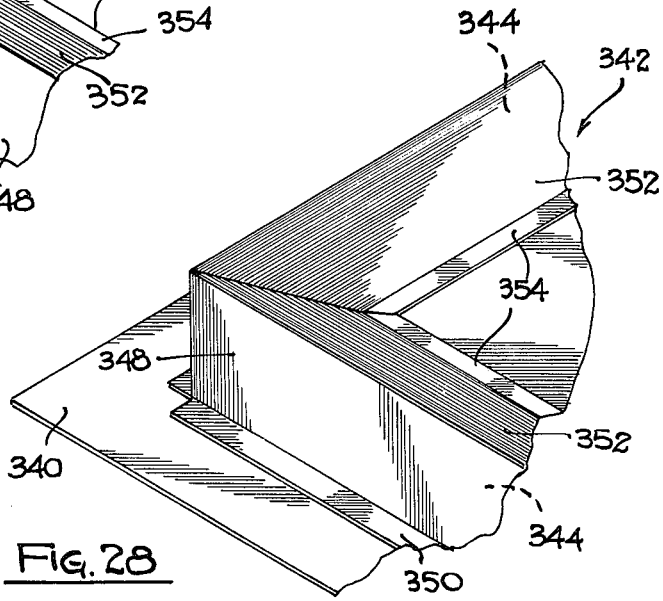
FIG. 28
FIG. 29
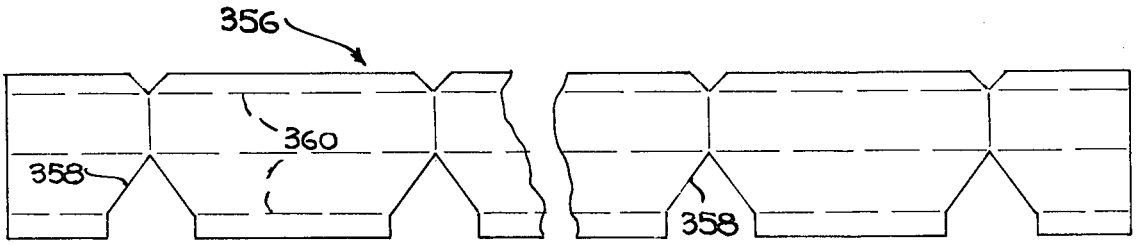

WATER BED MATTRESS HAVING A FLUID SUPPORT MEMBER

RELATED APPLICATIONS

This application is a continuation-in-part of Application Ser. No. 623,445, filed Oct. 17, 1975, and which is, in turn, a continuation-in-part of Application Ser. No. 581,262, filed May 27, 1975, now U.S. Pat. No. 4,006,501 dated Feb. 8, 1977.

BACKGROUND OF THE INVENTION

This invention relates in general to certain new and useful improvements in mattresses having liquid containing internal chambers and the method of making the same, and more particularly, to mattresses of the type stated which include an upper liquid chamber which is surrounded by a lower material containing chamber but which permits the upper chamber to be substantially contiguous with the upper surface of the mattress.

In recent years, water beds have become widely commercially acceptable and have found substantially increased use. It has now been fairly well recognized that water beds, that is those forms of beds which employ a water filled mattress, have not only enjoyment value, but therapeutic value as well. In general, it has been found that many people find that it is not only more enjoyable, but is more restful to sleep on a water bed mattress than other forms of conventional mattresses filled with solid, but nevertheless, resilient, material.

The present commercially available water bed mattresses generally comprise a rectangular shell formed primarily of some form of a fairly flexible plastic material and which is filled with water. This form of water bed mattress is thereupon supported in, and by virtue of its construction is required to be supported in, a rigid frame.

In recent years, there have been various other forms of water bed mattresses which include an air frame peripherally surrounding a water bladder, as for example in the Penn et al. U.S. Pat. No. 3,778,852, and the Pennington et al. U.S. Pat. No. 3,787,907. This latter form of water bed mattress, which includes a surrounding air frame, is typically referred to as an air frame water bed mattress. These air frame mattresses differ substantially from the pure water bed mattress, without the air frame, in that those mattresses including the air frame do not require the employment of a rigid structural frame.

The presently available water bed mattresses which do not include the air frame suffer from a large number of deficiencies such as the fact that these mattresses do not obviate the problem of wave action created in the water in the water chamber due to a sudden localized force. Consequently, when a person lies upon a water bed mattress without the surrounding air frame, the water shifts substantially, thereby creating substantial wave action and also the attendant displacement of the surface contour of the mattress.

The other forms of water bed mattresses including the air frame surrounding the water bladder, as exemplified by the Penn et al. Patent and the Pennington et al. Patent mentioned above, also suffer from a number of substantial disadvantages. It has again been well established that those water beds which include the surrounding air frame and which avoid the necessity of a rigid frame do not provide the required degree of comfort. It has been theorized that these water bed mattresses eliminate some of the wave action which is created by a sudden localized force. Nevertheless, it is also well established that the air bladder is relatively incompressible with respect to the water bladder. Consequently, the water bed mattresses which include the surrounding air frame do not provide constant and adequate support. The same generally holds true of those water bed mattresses which do not employ the air frame surrounding the water bladder. One of the primary problems of each of these conventional water beds is that they do not provide equal water flotation with respect to the entire upper surface of the water bed mattress.

Another important disadvantage with respect to the water bed mattresses of each of the aforementioned types is that they are not constantly sized with respect to a supporting structure or, otherwise, a supporting frame. Consequently, difficult often arises in fitting the water bed mattress, when filled with water, or otherwise with water in the water bladder and air in the air bladder, to the supporting frame or a supporting structure.

The present invention obviates these and other problems in the provision of a fluid containing mattress which includes a pair of upper and lower sheets having peripherally extending, perpendicularly struck side wall flaps. These side wall flaps are secured to each other in order to form an outer peripheral end wall, thereby defining a rectangularly shaped water bed mattress section forming an inner liquid chamber. In this way, the inner liquid chamber is established between the upper sheet, the lower sheet and the outer peripheral wall. Moreover, a material chamber is formed beneath the liquid chamber at least along the periphery thereof. This material chamber may be filled with a suitable material as hereinafter described and, when filled, surrounds at least the periphery of the liquid chamber along the lower sheet thereof and in adjacent relationship to the lower sheet and the inner peripheral end wall. In accordance with this construction, the liquid chamber is substantially contiguous with the upper sheet so that a person lying on the mattress is completely supported by the liquid chamber with constant flotation. Nevertheless, the lower material filled chamber contains air or another material which renders it essentially more rigid and surrounds at least the outer portion of the entire mattress, although the party lying on the mattress does not actually contact the lower material chamber section.

OBJECTS OF THE INVENTION

It is, therefore, the primary object of the present invention to provide a mattress construction which includes a liquid chamber having a surface substantially across the entire upper surface of said mattress and which is capable of supporting an individual, and a lower chamber surrounding at least a lower portion of the liquid chamber.

It is another object of the present invention to provide a mattress construction of the type stated which is relatively light in weight, when filled with water or comparable liquid in the liquid chamber, compared to commercially available forms of water bed mattresses.

It is a further object of the present invention to provide a mattress construction of the type stated which provides constant body support on the upper surface thereof.

It is an additional object of the present invention to provide a mattress construction of the type stated which is capable of reducing wave action in the liquid chamber of the mattress created by the impingement of localized forces.

It is also an object of the present invention to provide a mattress construction of the type stated which is durable in its construction and provides a safety feature substantially greater than any conventional available form of water bed mattress.

It is another salient object of the present invention to provide a method of making the mattress constructions of the type stated which is highly efficient in its operation and requires a minimal amount of manual labor.

With the above and other objects in view, my invention resides in the novel features of form, construction, arrangement and combination of parts presently described and pointed out in the claims.

SUMMARY OF THE INVENTION

A mattress construction for supporting an individual in an inclined position and which mattress construction comprises an upper sheet and a lower connected by a peripheral side wall which forms an internal liquid chamber often referred to herein as an "upper chamber". A material filled chamber, which is essentially impervious to the liquid in the liquid chamber, and which is not in fluid communication therewith, is also provided in the mattress construction and is often referred to herein as a "lower chamber".

This material chamber is located under a portion of the liquid chamber and provides support to at least the entire peripheral portion of the liquid chamber. The material chamber is substantially less yieldable when filled with material than the liquid chamber when filled with liquid, so that the material chamber provides at least continuous peripheral support by a material which is relatively less yieldable than the liquid in the liquid chamber. In the preferred embodiment of the invention, the material chamber extends substantially above the lower sheet along the entire periphery thereof, but in such manner that the entire surface of the upper sheet is supported by liquid in the liquid chamber.

This form of mattress construction can be further characterized in that the material chamber is essentially an air chamber and the liquid chamber is essentially a water chamber. In accordance with various embodiments of the invention taught herein, weight reducing material may be included within the liquid chamber. Moreover, the material containing chamber may be filled with a light-weight celled-type material. Otherwise, the material containing chamber may be filled with a relatively solid material.

One of the important aspects of the present invention is that the material chamber compresses the liquid chamber when both chambers are filled, respectively, with the material and the liquid so that the entire peripheral portion of the lower sheet is located substantially above the remaining portions of the lower sheet. In this case, the liquid chamber is substantially contiguous with the entire surface area of the upper sheet. In addition, the peripheral side wall may be urged in a configuration so that it inclines downwardly and inwardly when the material chamber and the liquid chamber are both filled.

Various embodiments of the construction of the material chamber with respect to the liquid chamber are disclosed in the instant application. In some embodiments, the air-filled or the material filled chamber may be connected to, but separate from, the liquid filled chamber. In still other embodiments the material filled chamber may actually form a part of an integral construction with the liquid filled chamber.

The present invention also provides several unique methods of making the water bed mattresses which are constructed in accordance with and embody the present invention. In this case, the method is closely related to the various water bed constructions previously described. Nevertheless, in one embodiment, the method comprises the folding of a plastic sheet in such manner that upper and lower sheet sections are formed along with peripheral side walls. In this particularly aspect, a flange on the upper sheet and a flange on the lower sheet are struck so that the two flanges can be combined. In addition, longitudinal flanges are also struck so that these two flanges can be combined in order to generate the interior liquid chamber. Moreoever, the air cylinder is formed by generating a piece of plastic in the form of a tubular member with an extended flange, and this extended flange is secured to the mattress as previously mentioned.

The present invention also provides a unique mattress including a lower peripherally extending air chamber or material chamber, as well as a unique method of making this mattress. In this case, the air chamber is formed by one or more pieces which are pre-cut to a desired shape so that they would be provided with exterior flanges on opposite sides for securement to the bottom sheet of the mattress. In this way, the panel will have the flanges thereof sealed to the bottom wall in spaced apart relationship so as to create an envelope or otherwise a material chamber therebetween. In this case, in order to manufacture this form of water bed mattress, the panel which is secured to the bottom wall may be previously cut with a desired shape so that it can be easily bent into the desired configuration and thereafter sealed to the bottom sheet forming part of the water bed mattress.

BRIEF DESCRIPTION OF THE DRAWINGS

Figure 1:
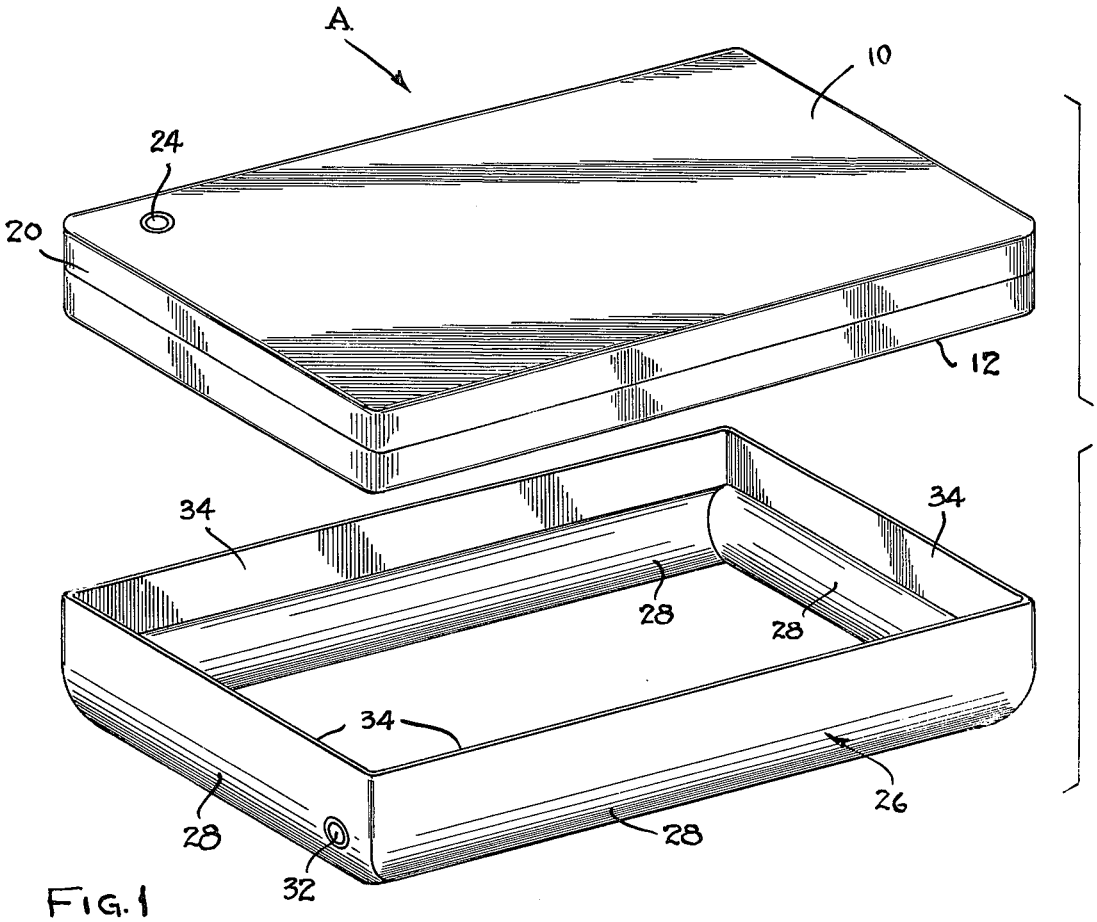
Figure 2:
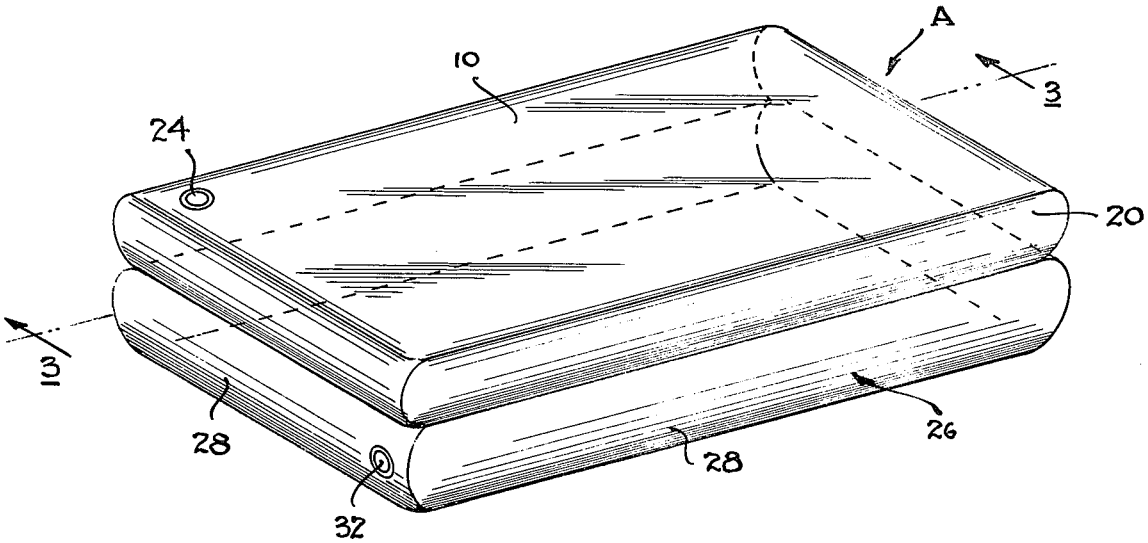
Figure 3:
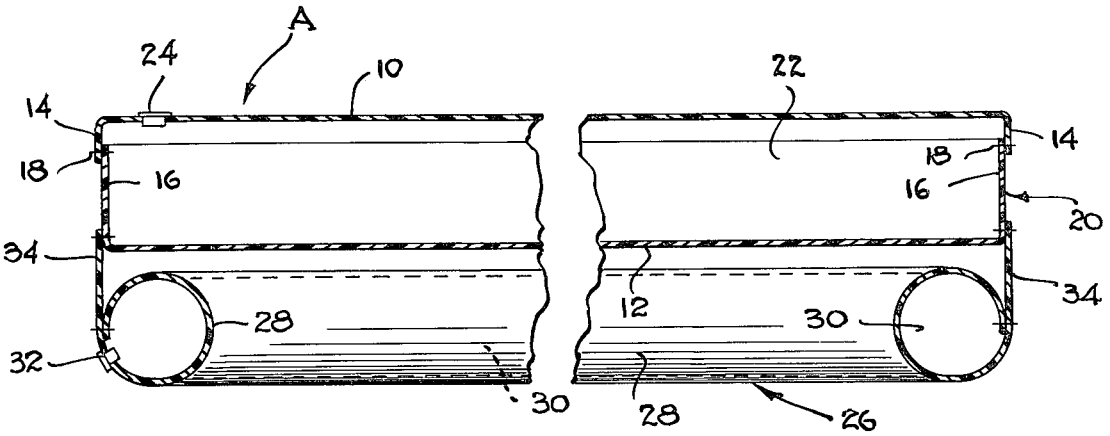
Figure 4:
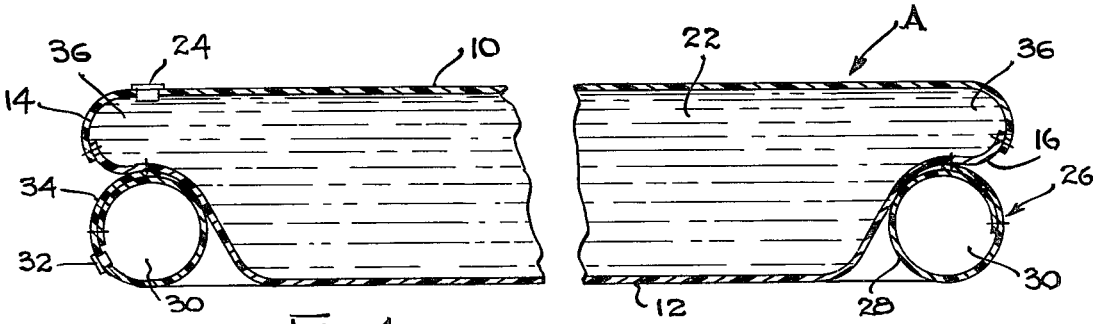
Figure 5:
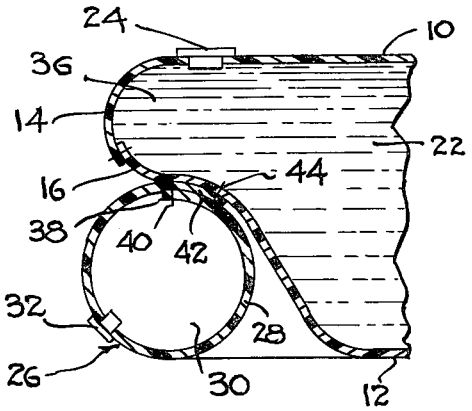
Figure 7:
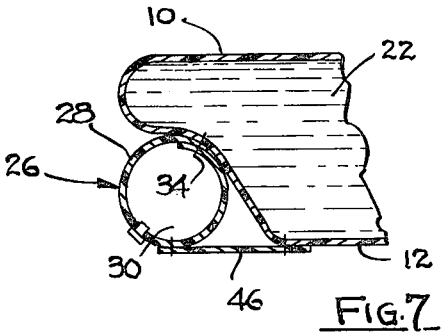
Figure 8:
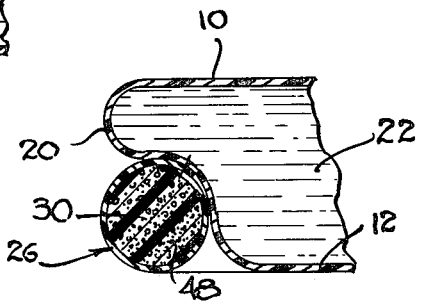
Figure 9:
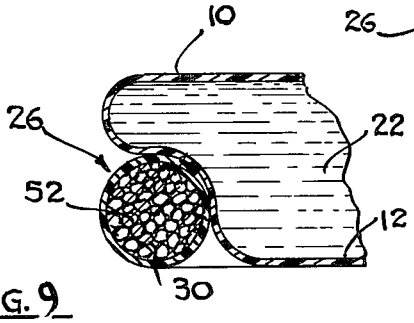
Figure 10:
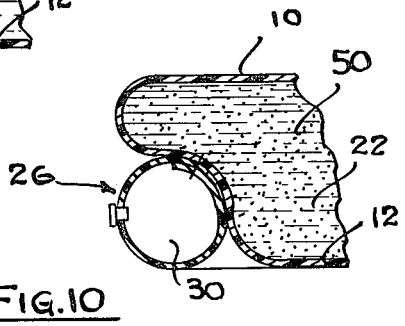
Figure 6:
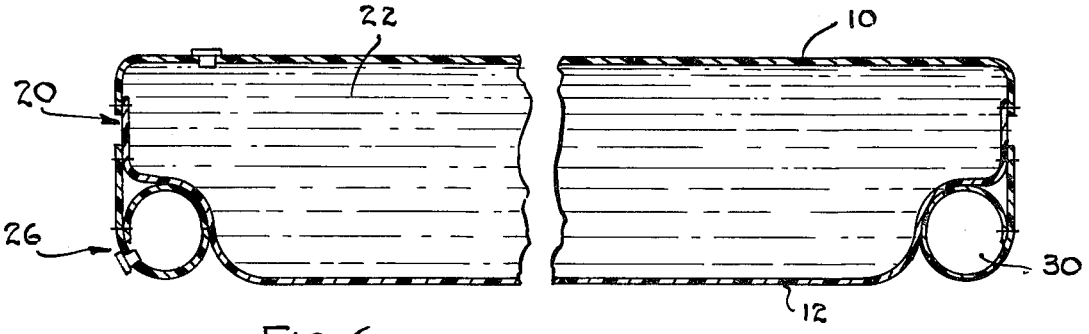
Figure 11:
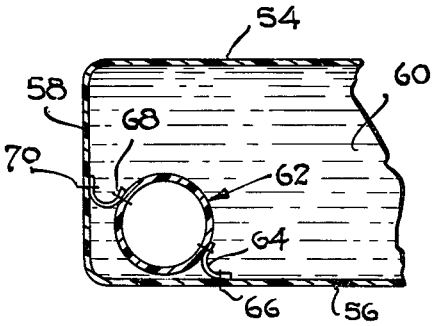
Figure 12:
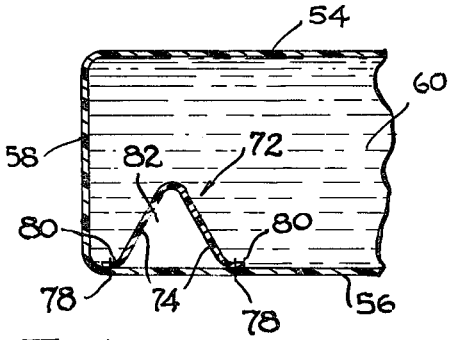
Figure 16:
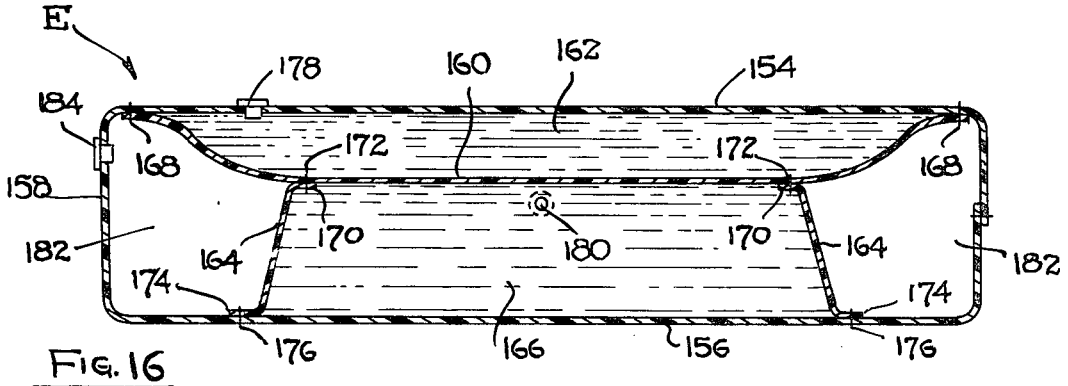
Figure 17:
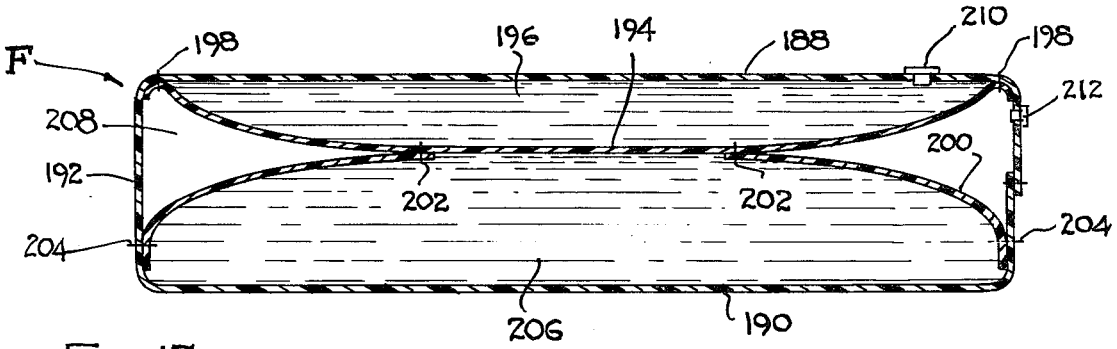
Figure 13:
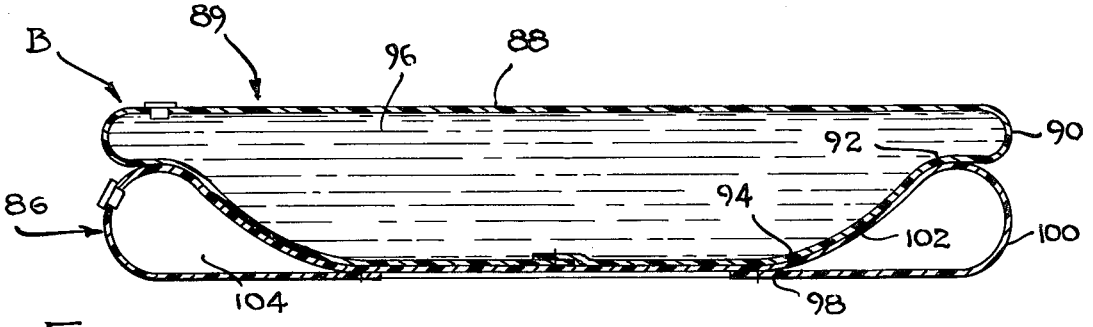
Figure 14:
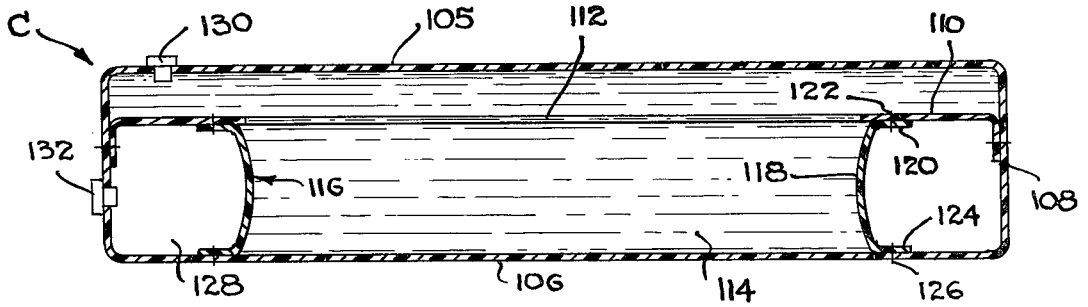
Figure 15:
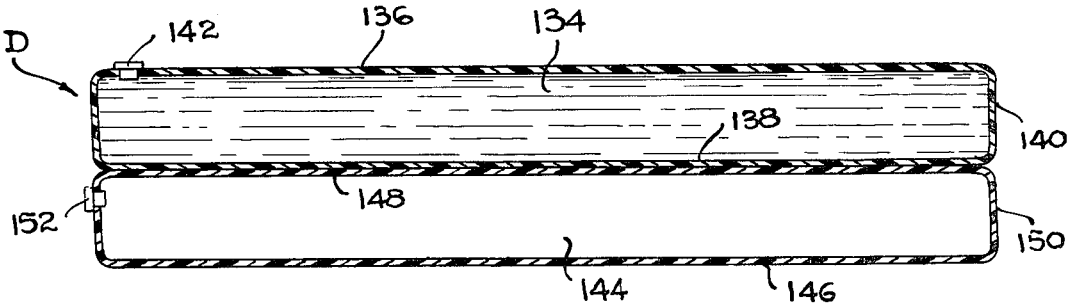
Figure 18:
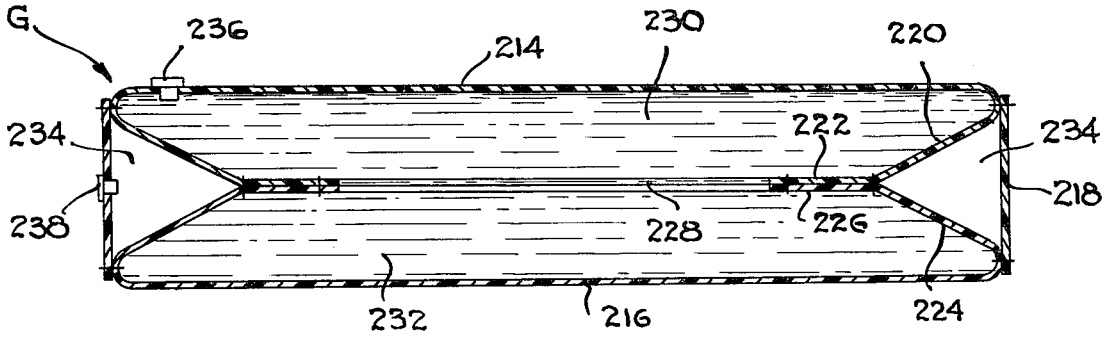
Figure 19:
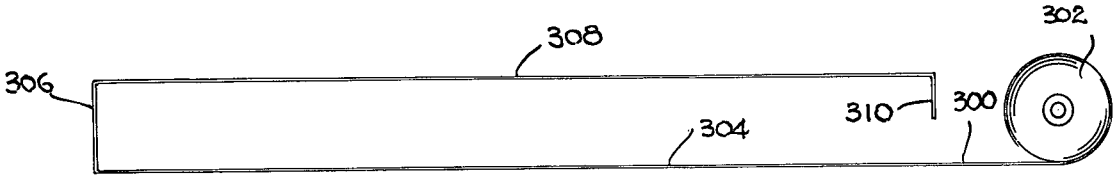
Figure 20:
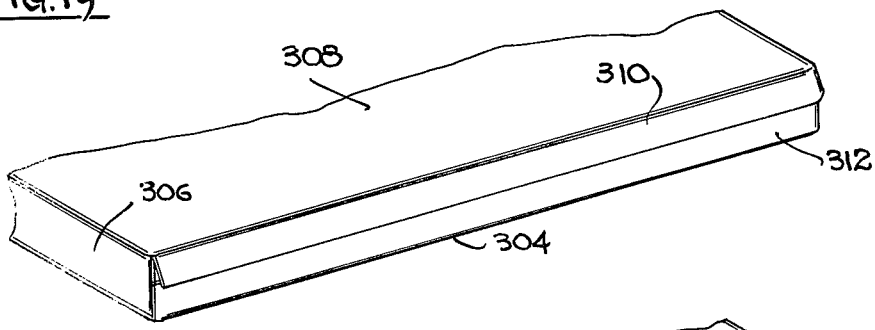
Figure 21:
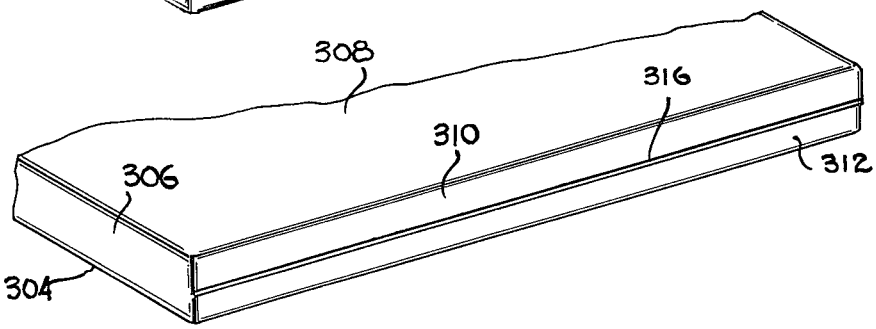
Figure 22:
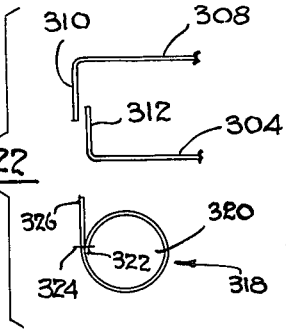
Figure 23:
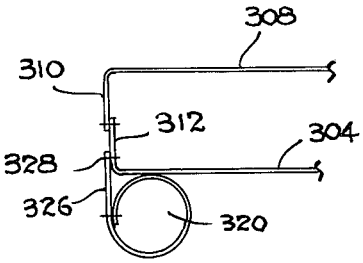
Figure 24:
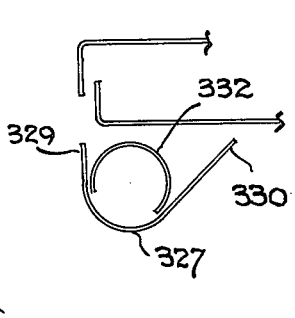
Figure 25:
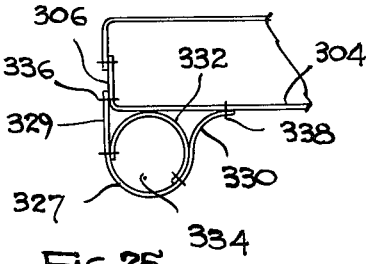

Having thus described the invention in general terms, reference will now be made to the accompanying drawings in which:

FIG. 1 is an exploded perspective view showing a water bed mattress having a water chamber and a peripheral air cylinder disposed beneath the water chamber and surrounding the periphery thereof;

FIG. 2 is a perspective view, similar to FIG. 1, and showing the relationship of the surrounding air chamber with respect to the water bed mattress when the water chamber is filled with water and the air chamber is filled with air and are both maintained in juxtaposed supportive relationship;

FIG. 3 is a vertical sectional view, taken along line 3—3 of FIG. 2, and showing the construction of the water bed mattress with the peripherally surrounding air support chamber with respect thereto;

FIG. 4 is a vertical sectional view, somewhat similar to FIG. 3, and showing the relationship between the air chamber and the water chamber when the water bed mattress is disposed in juxtaposed relationship to the air chamber;

FIG. 5 is an enlarged vertical sectional view, and showing the means of attachment of the air tube to the means forming the water chamber in FIG. 4;

FIG. 6 is a vertical sectional view, somewhat similar to FIG. 4, and showing a slightly modified form of water bed construction in accordance with the present invention;

FIG. 7 is a fragmentary vertical sectional view, somewhat similar to FIG. 4, and showing a water bed mattress construction where the air support cylinder is connected to the water bed mattress by two connecting strips;

FIG. 8 is a fragmentary vertical sectional view, similar to FIG. 4, and showing the air chamber functioning as a material support chamber which is filled with a foamable material, such as urethane;

FIG. 9 is a fragmentary vertical sectional view, similar to FIG. 8, and showing a material supporting chamber which is filled with a pelletized foam material;

FIG. 10 is a fragmentary vertical sectional view, similar to FIG. 7, and showing the water chamber having the inclusion of microballoons;

FIG. 11 is a vertical sectional view, somewhat similar to FIG. 4, and showing an air tube included within the liquid chamber forming part of the mattress of the present invention;

FIG. 12 is a vertical sectional view, somewhat similar to FIG. 4, and showing another modified form of water bed mattress construction wherein the material containing chamber is formed internally within the mattress;

FIG. 13 is a vertical sectional view, somewhat similar to FIG. 4, and showing another modified form of water bed mattress constructed in accordance with and embodying the present invention;

FIG. 14 is a vertical sectional view, somewhat similar to FIG. 11, and showing still another modified form of water bed construction in accordance with the present invention;

FIG. 15 is a vertical sectional view, somewhat similar to FIG. 11, of still another modified form of water bed mattress construction in accordance with the present invention;

FIG. 16 is a vertical sectional view, somewhat similar to FIG. 11, of a further modified form of water bed mattress construction in accordance with the present invention and which utilizes a pair of water chambers surrounded by a peripherally extending air chamber;

FIG. 17 is a vertical sectional view, somewhat similar to FIG. 16, and showing even a further modified form of water bed mattress construction which utilizes a pair of liquid chambers extending between the top and bottom walls of the mattress with a surrounding peripheral air chamber;

FIG. 18 is a vertical sectional view, somewhat similar to FIG. 17, and showing still another modified form of water bed mattress construction, but which utilizes a liquid chamber communicating with and extending between the top and bottom walls of the mattress;

FIGS. 19–25 are a series of sequential views showing a method of making some of the water bed mattress constructions in accordance with the present invention and in which:

FIG. 19 is a schematic view showing the unrolling of a portion of plastic material in order to form a water chamber;

FIG. 20 is a fragmentary perspective view showing the folding of side flaps in order to aid in the formation of the water chambeer within the water bed mattress of the present invention;

FIG. 21 is a fragmentary perspective view showing the sealing of the side flaps in order to enclose the water chamber of the water bed mattress of the present invention;

FIG. 22 is an exploded vertical detailed view showing the formation of the water bed mattress and supportive material chamber and the formation thereof;

FIG. 23 is a fragmentary vertical detailed view, somewhat similar to FIG. 22, and showing the relationship of the supportive material chamber with respect to the water bed mattress;

FIG. 24 is a fragmentary vertical detailed view, somewhat similar to FIG. 22, and showing a slightly modified form of the method of making the slightly modified form of water bed mattress of the type which is illustrated in FIG. 7;

FIG. 25 is a fragmentary vertical detailed view, somewhat similar to FIG. 24, and showing the supportive relationship of the material filled chamber with respect to the water bed mattress;

FIG. 26 is a fragmentary side-elevational view showing a plurality of panels used in the manufacturing of the water bed mattress of FIG. 12;

FIG. 27 is a fragmentary perspective view showing the connection of the panels of FIG. 26 in order to form a material chamber within the water bed mattress of FIG. 12;

FIG. 28 is a fragmentary perspective view, somewhat similar to FIG. 27, and showing the complete formation of the material chamber in the water bed mattress; and FIG. 29 is a side-elevational view of a slightly modified form of panel which may be used in creating the material-containing chamber utilized in the water bed mattress of FIG. 12.

DETAILED DESCRIPTION

Referring now in more detail and by reference characters to the drawings which illustrate preferred embodiments of the present invention, A designates a water bed mattress comprising an upper flexible plastic sheet 10 and a lower flexible plastic sheet 12, and both of which are substantially rectangular in their construction, but with rounded corner margins.

The upper and lower sheets 10 and 12 are both substantially of the same overall size and are marginally registered with each other, and the upper sheet includes an integrally formed downwardly struck, peripherally extending end flap 14. In like manner, the lower wall 12 includes an integrally formed upwardly struck, peripherally extending flap 16 which is lap-sealed to the end flap 14 at a seal 18, thereby forming a peripheral outer end wall 20 to thereby create an internal water chamber 22. In this case, it can be observed that the flap 14 which is integral with the upper wall 10 is located exteriorly of the flap 16 in order to form the lap-seal 18. However, it should also be understood that the flap 16 could be located exteriorly of the flap 14 in order to form the lap-seal 18.

Located on the top sheet 10 is a valve 24 which is provided for the introduction of water into the water chamber 22 or the removal of water therefrom. The valve 24 is essentially conventional in its construction, and it is therefore neither illustrated nor described in any further detail herein. Nevertheless, it should be observed that the valve 24 is provided with an annular flange which is heat sealed, or otherwise secured, to the top sheet 10.

Provided for use with the water bed mattress A and forming part thereof is a peripherally extending material support cylinder which preferably adopts the form of an air support cylinder 26. This air support cylinder 26 has a diametral size which is at least slightly less than the vertical dimension of the end wall 20 in the water bed mattress A. However, the air support cylinder 26 is peripherally extending in the form of a tube and does not have any solid interior portion. In this case, the air support cylinder 26 includes a cylindrically shaped wall 28 forming an internal material chamber, preferably an air chamber 30. Air may be introduced into the chamber 30 under pressure, or otherwise removed from the chamber, by means of a conventional valve 32. Moreover, the air support cylinder 26, in a preferred embodiment, may be secured to the peripheral side wall 20 by means of a flexible strap 34. In this case, the flexible strap 34 may be a peripherally extending member and which is secured to the peripheral side wall 20 along its entire peripheral dimension. However, it can also be observed that a plurality of short segment forming support straps 34 could be utilized to secure the air support cylinder 26 to the end wall 20 of the water bed mattress A.

By further reference to FIG. 4, it can be observed that when the air support cylinder 26 and the liquid chamber 22 are both filled with material and liquid, respectively, the peripheral portions of the lower sheet 12 and the side wall 20 are compressed inwardly in order to form a somewhat inclined peripheral wall, as illustrated in FIG. 4. In this case, it can be observed that the outer peripheral end wall 20 is compressed inwardly convexly with respect to the liquid chamber 22. In this way, the peripheral end wall 20 is located somewhat diagonally inwardly with respect to the bottom wall 12 and the top wall 10 such that a small liquid space, designated by reference numeral 36, is located between the then inwardly struck peripheral wall 20 and the top sheet 10, such that an individual supported on the mattress A is entirely supported by the liquid contained within the liquid chamber 22.

It can also be observed that the peripheral side wall 20 is urged into a somewhat diagonally inwardly extending section, as previously described, and merges into the bottom wall 12. In accordance with this construction, the outer margin of the bottom wall 12 is located inwardly of the outer peripheral margin of the top sheet 10. Thus, the entire peripheral portion of the mattress A is supported by the material contained within the material chamber 30, but, nevertheless, an individual lying on the top sheet is entirely supported by the liquid contained in the liquid chamber 22.

As indicated previously, the material chamber may be filled with any of a number of materials as hereinafter described, although the preferred material is air. Consequently, this material chamber 26 will be described as an air support chamber or an air support cylinder, although it should be understood that any of a number of materials may be utilized therein. In like manner, while the liquid chamber has been described as being filled with a liquid with respect to many of the remaining embodiments, the liquid chamber will be described as being filled with water, although it should be understood that water is only one of the liquid substances which may be utilized herein.

FIG. 5 is an enlarged fragmentary vertical sectional view, somewhat similar to FIG. 4, and showing the formation of the air cylinder with respect to the remaining portions of the water bed mattress. In this case, it can be observed that the air support cylinder 26 is formed by a continuous strip of material which is rolled into the form of a cylindrical tube to form the internal chamber 30. This strip of material is rolled such that one terminal margin 38 is secured to the interior surface of the material by means of a heat seal 40 in order to complete the tubular member. The other longitudinal margin of this material is extended into the form of a flap 42 which is heat sealed to the peripheral side wall 20 and typically to the lower flap 16, by means of a heat seal 44. In accordance with this construction, the material containing chamber can be easily formed and can also be easily secured to the side wall of the liquid containing chamber.

FIG. 6 illustrates, in a fragmentary vertical sectional view, a slightly modified form of water bed construction in accordance with the present invention. In this case, it can be observed that the air cylinder 26 is of somewhat smaller diameter than the air cylinder utilized in the apparatus A., and a slightly larger depth of water exists between the top sheet 10 and the air cylinder 26. Nevertheless, this embodiment of the water bed mattress construction of the present invention operates in the same manner as the water bed mattress A illustrated in FIGS. 1–5.

FIG. 7 illustrates a fragmentary vertical sectional view, somewhat similar to FIG. 4, and showing another modified form of mattress of the present invention. In this case, the air cylinder 26 is comprised of a pair of straps, including the strap 34 and an additional strap 46, the latter of which is secured to the cylindrically shaped side wall 28 of the tube 26 and also to the bottom wall 12. Again, it should be understood that a number of individual segmented straps located along the bottom wall 12 and connected to the cylindrical side wall 28 could be utilized in order to secure the air support cylinder 26 to the mattress as illustrated in the present invention.

With respect to the water bed mattress A, as well as the other water bed mattresses hereinafter described, these mattresses, and the components thereof, can be formed of any of a number of known plastic materials and include, for example, various forms of vinyl sheets, polyethylene, polystyrene, polybutadiene, copolymers thereof and the like. One of the preferred materials which is used in the water bed mattresses of the present invention are forms of polyvinylchloride. While the materials mentioned above are thermoplastics in nature, it should be understood that many thermosetting resins could also be used. In addition, various flexible nonplastic materials could also be employed, as for example various textile materials which are water impervious and which may be plastic impregnated, such as those cloth materials which are impregnated with a vinyl plastic material to render the same water impervious. The upper and lower sheets, as well as the peripheral side wall, should preferably have a thickness of about no less than 20 mils. However, the desired thickness may be predicated upon the overall size of the water bed mattress itself.

In each of the aforesaid embodiments of the water bed mattress described herein, these embodiments have been described in connection with the utilization of a water bladder and an air bladder. Nevertheless, the water bladder, or water chamber, may be provided with any liquid medium which is capable of reducing the overall weight of the water bed mattress. One of the primary problems in the use of many water bed mattresses is that the supporting structure, such as the floor in the house or other enclosure, is not oftentimes capable of supporting the weight of several hundred gallons of water. Consequently, it is desirable to reduce this weight as much as possible, without otherwise compromising the effects of the air bladder which is designed to reduce sharp impingement of localized forces, wave motion and the like. Thus, the water chamber is oftentimes referred to herein as a liquid or otherwise a fluid chamber and which may accommodate liquids other than water.

In many cases, the liquids could be provided with another substance in order to reduce a specific weight thereof, but nevertheless provide the required support in the same manner as water provides such support. In addition, other materials may be incorporated in the air chamber so that air is not required to be introduced into this inner chamber. Moreover, by physically incorporating such solid or semi-sold materials in the chamber which normally incorporated the air chamber and which is hereinafter referred to as a "chamber containing a material therein" or the like, it is possible to eliminate the extra valve for introducing air into this chamber or bladder.

FIG. 8 illustrates another embodiment of a water bed mattress and which is similar to the water bed mattress illustrated in FIGS. 1–4 of the drawings. The water bed mattress also comprises an upper wall 10, a lower wall 12 and a peripheral end wall 20. The mattress is provided with a liquid containing chamber 22 and an air support ring 26 provides a material containing chamber 30. In this case, the liquid chamber 22 would normally contain a liquid, which could be water, or any other form of liquid. In many cases, the other liquid could actually be a mud solution. Nevertheless, the material containing chamber 30 could be provided with a solid material which, in this case, could be a urethane foam, or other foamable or plastic material, designated by reference numeral 48. It can be observed that in the manufacture of the mattress, in this case, the urethane material could be formed by actually including a precatalyzed polyol and polyisocyanate, such as a diisocyanate, and which materials are reactive to form the actual urethane in order to completely fill the liquid chamber 22.

FIG. 10 illustrates a further modified form of mattress of the present invention, and which similarly includes a liquid chamber 22 and a material containing chamber 30. In this case, the material containing chamber 30 may include any of those solid or semi-solid materials included in the chamber 22. Moreover, the liquid chamber 22 may include water or any other form of liquid material. However, in this case, microballoons 50 are incorporated in the liquid. These microballoons are well-known in their construction, and therefore are neither illustrated nor described in any further detail herein. However, it is important to note that these microballoons do not hinder the support provided for an individual inclined on the upper surface of the mattress, but nevertheless substantially reduce the weight thereof. In the same respect, it should also be observed that a gelling agent could be included in the liquid chamber so that the liquid may be thickened, and actually be somewhat of a semi-solid or otherwise a semi-liquid, it is still referred to herein as a liquid. For example, such suitable gelling agents which may be used are carboxymethyl cellulose or the like.

One of the unique aspects of the present invention is that the material chamber is substantially less yieldable when filled with the material than the liquid chamber when also filled with the liquid, so that the material chamber extends substantially above the lower sheet of the water bed mattress. In this way, the entire surface of the upper sheet is supported by liquid in the liquid chamber and that the material chamber provides continuous support, at least peripherally, by a material which is relatively less yieldable than the liquid in the liquid chamber. In this respect, the material chamber literally compresses the liquid chamber when the chambers are filled respectively with material and liquid so that the entire peripheral portion of the lower sheet is located substantially above the remaining portion of the lower sheet. Nevertheless, the liquid chamber is substantially contiguous with the entire upper surface of the upper sheet forming part of the water bed mattress.

FIG. 9 illustrates yet another modified form of mattress of the present invention and which also includes a liquid chamber 22 and a material containing chamber 30. In this embodiment of the invention, the material containing chamber is filled with a form of pelletized material which may adopt the form of various types of particulate matter. In this same respect, the water bed mattress of FIG. 9 is in many ways similar to the water bed mattress of FIG. 8, although the material containing chamber is provided with the pelletized form of material as opposed to a urethane-forming plastic material or other plastic material which may be formed by the introduction of various reagents thereinto in order to produce the foamable plastic material. Moreover, and by reference to FIG. 9, it can be observed that the pellets forming part of this pelletized material are designated by reference numeral 52.

FIG. 11 represents a fragmentary schematic sectional view of another modified form of water bed mattress constructed in accordance with and embodying the present invention. In this case, the water bed mattress of FIG. 11 also includes a top sheet 54 and a bottom sheet 56, along with a peripherally extending side wall 58 forming an interior liquid chamber 60, much in the same manner as the water bed mattress of FIGS. 1–3 of the drawings. In addition, a tubular air support cylinder 62, similar in construction to the air support cylinder 26, is included within the liquid chamber 60. This air support cylinder 62 may also adopt the form of a cylindrical ring as illustrated in FIG. 11, and which extends continuously around the lower portion of the water bed mattress in close proximity to the bottom wall 56 and also in adjacent relationship to the peripheral side wall 58. Moreover, the air support cylinder 62 may be secured to the bottom wall 56 through an attachment strap 64 heat sealed to the bottom wall 56 by means of a heat seal 66. In like manner, this air support ring 62 may also be heat sealed to the side wall 58 by means of an attachment strap 68 through a heat seal 70. In this way, the air support ring 62, when filled with air, will be secured in the relationship as illustrated in FIG. 11, and nevertheless provide the peripheral edge support to the mattress as previously described.

FIG. 12 illustrates another form of water bed mattress construction which has been constructed in accordance with and embodies the present invention. In this case, the water bed mattress similarly includes a top wall, similar to the top wall 54, a bottom wall, similar to the bottom wall 56, and a continuous peripherally extending side wall, similar to the side wall 58, in order to form a liquid chamber 60 therebetween.

In the aforesaid copending application, Ser. No. 623,445, as well as the aforesaid copending application, Ser. No. 581,262, a water bed mattress construction was described as including a peripheral air support or similar material support chamber located on the lower portion of the mattress which provided the peripheral edge support to the upper sheet of the mattress. In this respect, the water bed mattress construction of FIG. 12 is somewhat similar, although the means for achieving this edge support is slightly different. In this case, the material support chamber is formed by a panel 72 which is folded over to provide a pair of inclined side walls 74 and which are heat sealed to the bottom wall 56 by means of heat seals 78 through flanges 80 integrally formed with the side wall 74, in the manner as illustrated in FIG. 12. In this way, the pair of inclined side walls 74 form a material chamber 82. In this case, the material chamber is shown as being located within the lower portion of the liquid chamber, although it should be understood that this material chamber could extend upwardly in close proximity to the upper sheet 54, if desired.

One of the important aspects of the water bed mattress illustrated in FIG. 12 is that when the material chamber 82 is filled with material and the liquid chamber 60 is also filled with a liquid, the material chamber 82 which is filled, such as with air, will expand so that one of the side walls 74 thereof will be located in close proximity to the side wall 58. In this way, the chamber 82 will provide the same peripheral support as was provided by the air chambers in the aforementioned copending patent applications.

FIGS. 13–18 also illustrate water bed mattress constructions which are similar in their relationship to the water bed mattress constructions previously described. FIG. 13 represents a water bed mattress B which includes a first liquid chamber forming envelope 84 and a second material chamber forming envelope 86. In this case, the chamber forming envelope 84 includes a top wall 88 which merges into a peripherally extending side wall 90 of relatively short dimension, and which, in turn, merges into a somewhat horizontally disposed support strip 92, as illustrated in FIG. 13 of the drawings. This peripherally extending support strip merges into a somewhat arcuately shaped intermediate wall 94 which extends downwardly as illustrated in order to form a liquid chamber 96. It can be observed that this liquid chamberforming envelope 84 may be formed of a single piece of foldable flexible plastic material as illustrated.

Located beneath the envelope 84 is the material chamber forming envelope 86 which in this case comprises a bottom sheet 98 merging at its upper end into a peripherally extending chamber side wall 100. This side wall 100 is curved into a lower intermediate sheet 102 which is located in juxtaposed relationship and in physical contact with the bottom wall 94, and also forms a material containing chamber 104. In accordance with this embodiment of the present invention, it can be observed that the material containing chamber 104 is designed so that the entire mattress is constructed with the material containing chamber only providing peripheral edge support. In this respect, it can be observed that the wall 94 is formed of sufficient material to extend downwardly and to in effect compress the sheet 102 into contact with the bottom wall 98 as illustrated. In this way, the liquid containing chamber 96 is formed, and the material containing chamber 104 is also formed in the configuration as illustrated such that the material containing chamber 104 provides peripheral continuous edge support to the liquid-containing chamber 96.

FIG. 14 illustrates in vertical sectional view another modified form of water bed mattress construction C which is, in many respects, similar to the previously described water bed mattresses of the present invention. In this respect, the water bed mattress C comprises a top wall 105 and a spaced apart, essentially parallel bottom wall 106 connected by a peripherally extending side wall 108. An intermediate divider 110 extends across the mattress C in essentially parallel relationship to the top wall 105 and the bottom wall 106 and is provided with a substantially enlarged aperture 112 in the center thereof in order to create a water chamber 114. A somewhat rectangularly shaped divider 116 is provided with a vertical side wall 118 and an arcuately, outwardly curved flange 120 which is heat sealed to the intermediate panel 110 by means of a heat seal 122. In like manner, the side wall 118 is also provided with an outwardly struck flange 124 which is heat sealed to the bottom wall 106 by means of a heat seal 126 to thereby form a material chamber, such as an air chamber 128. In this way, the air chamber forms a lower water chamber portion which communicates with an upper water chamber portion, the latter of which is contiguous with and completely supports the upper sheet 105, in the manner as illustrated in FIG. 14.

A conventional valve 130 is provided on the upper sheet 105 for permitting the introduction of water into and the removal of water from the water chamber 114. In like manner, the side wall 108 is provided with a valve 132 which permits the introduction of air, or other material, into the material containing chamber 128. These two valves 130 and 132 are essentially conventional in their construction and are similar to the previously described valves, as for example, the valves 22 and 24.

FIG. 15 represents a further modified form of water bed mattress construction D which is also constructed in accordance with and embodies the present invention. In this case, the water bed mattress D comprises a liquid chamber, or otherwise water chamber, 134 which is formed by a top wall 136, and an upper intermediate wall 138, and which are connected by a peripherally extending side wall 140. The upper sheet 136 is provided with a valve 142, similar to the valve 120, for the introduction of water or other liquid into and removal from the chamber 134. Disposed beneath the upper intermediate sheet 138 is a material containing chamber 144 which is formed by a lower sheet 146 and a lower intermediate sheet 148 and which are connected by a peripherally extending side wall 150 in order to form the material containing chamber 144. In this case, the upper intermediate sheet 138 and the lower intermediate sheet 148 may be connected if desired. The peripheral side wall 150 which forms part of the material chamber 144 may also be provided with a valve 152, similar in construction to the valve 122, for permitting the introduction and removal of air or other form of material to the chamber 144. In this embodiment of the invention, the material containing chamber 144 provides complete material support to the entire undersurface of the liquid chamber 134.

With respect to the water bed mattress D illustrated in FIG. 15, this mattress D illustrates a material chamber which is located completely underneath and provides continuous support to the liquid chamber. This is one form of water bed mattress which may be utilized in accordance with the present invention. However, it has been found that while this form of water bed mattress D is effective, the other forms of water bed mattresses which only provide peripheral edge support to the liquid chamber are more effective.

FIG. 16 illustrates another modified form of water bed mattress E which is also constructed in accordance with and embodies the present invention. This water bed mattress E is comprised of a top wall 154 and a bottom wall 156 which are connected by a peripherally extending side wall 158. In this case, the side wall 158 can be formed by folding the top wall 154 over the bottom wall 156 in a single sheet of material and forming upwardly and downwardly struck flaps on the upper and lower walls in order to form the peripheral side wall 158 as illustrated.

Heat sealed to the top wall 154 in close proximity to its peripheral end margins is an intermediate sheet 160 which forms a water chamber 162 between the top wall 154 and the intermediate wall 160. Similarly secured to the intermediate wall 160 and the bottom wall 156 is a peripherally extending, somewhat vertically disposed interior wall 164 which similarly forms a water chamber 166. In this case, it can be observed that the terminal margins of the intermediate wall 160 are heat sealed to the upper wall 154 by means of heat seals 168. In like manner, the somewhat vertically disposed interior wall 164 is provided at its upper end with an inturned flange 170 secured to the intermediate wall 160 through heat seals 172. In like manner, the interior wall is provided at its lower end with an outwardly struck peripherally extending flange 174 which is heat sealed to the bottom wall 156 by means of a heat seal 176.

A conventional valve 178 is provided in the top wall 154 for introducing water into and removing water, or other forms of liquid, from the liquid chamber 162. A similar valve 180 is also located in the side wall 158 for introducing water or other liquid into the liquid chamber 166. A similar valve 184, of conventional construction, is also located in the side wall 158 for introducing material, such as air, into the material containing chamber 182. In this respect, it should be observed that the valve 180 would be provided with an extended stem in order to extend into the liquid chamber 166. In like manner, the valve 180 could also be located on the upper wall 154 and extend through the intermediate wall 160 into the chamber 166.

By further reference to FIG. 16, it can be observed that the intermediate wall 160 and the inner wall 164, along with the peripherally extending side wall 158, form a material containing chamber, such as an air chamber, 182 which extends substantially around the entire periphery of the mattress. In this case, it can be observed that the material containing chamber 182 supports a substantial portion of the underside of the intermediate wall 160 and terminates at the peripheral edge of the top wall 164 in the manner as illustrated in FIG. 16. In this way, a material containing chamber provides peripheral edge support to the liquid in the liquid chamber 162. Nevertheless, the liquid chamber 162 has a major portion supported by an additional liquid chamber 166 as illustrated.

FIG. 17 illustrates another modified form of water bed mattress designated as F which also includes a top wall 188 and a bottom wall 190 connected by a peripherally extending side wall 192. Again, the side wall 192 may be formed in the same manner as the side wall 158 in the water bed mattress E, illustrated in FIG. 16. Secured to the top wall 188 along the peripheral margin thereof is an intermediate wall 194 which forms a liquid chamber, such as a water chamber, 196 along the underside of the top wall 188. In this case, it can be observed that the intermediate wall 194 is formed of sufficient material so that the major portion thereof is located in downwardly spaced relationship to the top wall 188 in order to form the water chamber 196. By further reference to FIG. 17, it can be observed that the intermediate wall 194 is provided with a peripherally extending flange which is secured to the top wall 188 through a heat seal 198.

A peripherally extending panel 200 is provided with a terminal flange secured to the underside of the intermediate wall 194 by means of a heat seal 202. In addition, the peripherally extending panel 200 is provided at its lower end with a portion which is heat sealed to the lower end of the side wall 192 through a heat seal 204. In this way, the peripherally extending panel provides a second water chamber, or otherwise liquid containing chamber, 206 formed by the bottom wall 190, the underside of the intermediate wall 194 and the peripherally extending panel 200. It can be observed that the upper water chamber 196 is not in communication with the lower liquid chamber 206. In addition, the side wall 192, along with a portion of the intermediate wall 194 and the peripherally extending panel 200, forms an air or otherwise material containing chamber 208. In this case, it can be observed that the material containing chamber 208 is located along the entire periphery of the mattress and extends toward the upper wall 188 and terminates in contiguous relationship to the periphery of the upper wall 188. However, it can also be observed that the material containing chamber 208 also does provide the peripheral edge support to the liquid chamber 196 in the manner as previously described. The lower liquid chamber 206 also provides additional liquid support to the upper liquid chamber 196.

A conventional valve 210 is located in the top wall 188 for introducing water or other liquid into the liquid containing chamber 196. In like manner, a similar valve (not shown) would be provided for introducing liquid into the liquid containing chamber 206. Moreover, a similar valve 212 is also provided for introducing air or other material into the material containing chamber 208, in the manner as illustrated in FIG. 17 of the drawings.

When considering the water bed structures of FIGS. 16 and 17, it can be observed that these water bed mattresses provide the same peripheral edge support to the upper sheet as in the case of the previously described water bed mattresses. Consequently, these water bed mattresses are equally as effective and, in addition, provide additional liquid support to the upper liquid chamber. It has been found that there is actually some difference in providing support to the upper liquid chamber by the provision of a lower liquid chamber which is not in communication with the upper liquid chamber. Thus, for example, the upper chamber 162 in the water bed mattress E is provided with undersupport by the chamber 166. In this case, when sudden localized forces are imposed on the upper wall 154, wave action is not fully transmitted to the lower liquid chamber 166. Nevertheless, peripheral support is provided by the material-containing chamber 182. The same results hold true with respect to the water bed mattess F illustrated in FIG. 17 of the drawings.

FIG. 18 illustrates even a further modified form of water bed mattress G which is similar in many ways to the water bed mattress F of FIG. 17. The water bed mattress G also comprises a top wall 214 and a bottom wall 216 in spaced apart, parallel relationship and connected by a peripherally extending end wall 218. In the case of the water bed mattress G, it can be observed that the top wall is provided with a downwardly struck, inwardly and angularly disposed flange 220 which terminates in a horizontally disposed upper intermediate wall 222. The bottom wall 216 is similarly provided with an inwardly and upwardly struck flange 224 extending therearound and which terminates in a horizontally disposed lower intermediate wall 226. In this case, an aperture 228 is formed between the two intermediate walls 222 and 226, thereby forming an upper liquid chamber 230 and a lower liquid chamber 232 which are in communication with each other through the aperture 228. The side wall 218 which is connected around the periphery of the upper wall 214 and the lower wall 216 form a material containing chamber 234.

Suitable valves, such as those valves illustrated in FIGS. 16 and 17, would be employed in the water bed mattress G. Thus, the water bed mattress includes a first conventional valve 236 for introducing liquid, such as water, into the liquid chamber 230, and also the liquid chamber 232. In addition, the side wall 218 is provided with a valve 238, of conventional construction, which permits the introduction of material, such as air, into the chamber 234.

It can be observed that the water bed mattress G as illustrated in FIG. 18 is in many ways similar to the construction of the water bed mattresses in FIGS. 16 and 17. Moreover, the water bed mattress G operates in like manner in order to provide peripheral edge support by the material in the material containing chamber 234 to the upper all 214.

Several unique features are inherently created by the water bed mattress constructions of the present invention which include the relatively light weight thereof compared to other conventional prior art water bed mattresses, and which is in part due to the large air chamber which surrounds the lower portion of the water chamber. In addition, the water bed mattress constructions of the present invention provide a more substantially constant support due to the fact that the air bladder is effectively located under the water bladder and which thereby produces a constant flotation on the top of the water bed mattress. In addition, the air chamber serves to effect as a baffle which thereby inhibits water motion and, hence, the wave action which would otherwise be created by a sudden impact or otherwise a localized force impingement on the surface of the water bed mattress. In this way, it can be observed that there is an increased ease of exit and entry with respect to the water bed mattress.

In the conventional complete water bladder mattress, it was virtually impossible to sit on the edge of the water bed inasmuch as the water would displace and the sheet portion in the area of displacement would collapse. In the conventional air frame surrounded water bed mattress, the air frame was too rigid and thereby prevented an effective resting while in sitting positions.

In addition to the above, the water bed mattress constructions of the present invention provide a substantially increased fit with respect to a surrounding support frame. Moreover, several of the water bed mattress constructions of the present invention provide a substantially increased safety factor when compared to any other conventional form of water bed mattress. In many cases, it can be observed that the air chamber substantially completely surrounds the entire peripheral end wall of the water chamber. Moreover, the air chamber in many cases surrounds a substantial quantity of the lower portion of the water chamber, such that if any portion of the sheet material forming the water chamber were perforated or otherwise punctured, the air chamber surrounding this water chamber would prevent discharge of any of the water which might otherwise be expelled from the water chamber.

FIGS. 19 through 29 illustrate several embodiments of making the water bed mattresses of the present invention. While the methods of making the water bed mattresses heretofore described in connection with FIGS. 1–18 have actually been set forth in connection with the description of these mattresses per se, further description of the methods of making these water bed mattresses is set forth in connection with the accompanying FIGS. 19–29.

FIGS. 19–25 more fully illustrate the method of making the water bed mattresses of the type illustrated in FIGS. 1–11 of the drawings. In this case, the water bed mattress is made by taking an initial sheet of foldable flexible plastic material, designated as 300, and unrolling the same from a roll 302 of this plastic material. In this case, the sheet 300 is unspooled from the roll 302 in order to form a lower wall 304 equivalent to the lower wall 12. The sheet is folded upwardly through a vertically extending side wall 306 equivalent to a portion of the side wall 20 and into a top wall 308 which is essentially equivalent to the top wall 10. Moreover, at its opposite end, the top wall end is provided with a downwardly struck flange 310 equivalent to the flange 14. In like manner, the bottom wall 304 is provided with an upwardly struck flange 312 equivalent to the flange 16. It can be observed that one portion of the peripheral side wall 306 is integral with the top wall 308 and the bottom wall 304, whereas the remaining three sides are provided with the downwardly struck flanges 310 on the top wall 308 and the upwardly struck flanges 312 on the bottom wall 304. These flanges are heat sealed together by means of a heat seal 316 equivalent to the heat seal 18 in order to thereby form the interior water chamber 22. This portion of the water bed mattress forms the liquid-containing chamber as previously described.

By further reference to FIGS. 22–25, it can be observed that the material containing chamber is also formed and thereafter connected to and forms part of the water bed mattress as previously described. In this case, the material-containing chamber is formed by a strip of foldable flexible plastic material 318 which is curved in order to form a complete tubular chamber 320. One end of the sheet 318 is provided with a flange 322 which is heat sealed to the juxtaposed portion of the sheet 318 by means of a heat seal 324. The remaining portion of the sheet 318 constitutes a flange 326 which is heat sealed to the upwardly struck flange 312 by means of a heat seal 328, as illustrated in FIG. 23 of the drawings. In this way, it can be observed that the material containing chamber is physically connected to the side wall of the water bed mattress and which nevertheless forms a complete material containing chamber 320. It should also be understood in this respect that suitable valves, such as the valve 24 and the valve 32, would be provided for introduction of liquid into the liquid chamber and material into the material containing chamber.

FIGS. 24 and 25 more fully illustrate the method of making the water bed mattress of FIG. 7. In this case, it can be observed that the material containing chamber is formed by a first peripherally extending strip 327 having terminal flanges 329 and 330 which are respectively heat sealed to the peripheral side wall and the bottom wall of the portion of the mattress forming the liquid chamber. In addition, a second strip 332 is folded over and secured to the interior surface of the strip 327 in order to form a material containing chamber 334 equivalent to the material containing chamber 320, or otherwise the material containing chamber 30 as illustrated in the aforementioned water bed mattresses.

The terminal portions 329 and 330 can be easily heat sealed to the side wall and the bottom wall, respective, of those portions of the water bed mattresses which form the liquid chamber. FIG. 25 illustrates the terminal portion of the flange 327 being secured to the side wall 306 through a heat seal 336. In addition, the flange 330 is secured to the bottom wall 304 through a heat seal 338. In this way, it can be observed that the material containing chamber can be secured to the liquid containing chamber by a pair of peripherally extending flaps. In the same respect, it can be observed that the size of the material containing chamber can be varied and, moreover, the material included therein can also be altered in order to form any of the water bed mattress constructions illustrated in FIGS. 1–11 of the drawings.

FIGS. 26–29 more fully illustrate the method of making the water bed mattress of FIG. 12. In this case, the method comprises the employment of a bottom sheet 340 equivalent to the bottom wall 56. Thereafter, a panel 342 equivalent to the panel 72 is folded in order to form a material containing chamber 344. The panel 342 may actually be constructed of a plurality of discrete segments designated as 346 and illustrated in FIG. 26 of the drawings. In this case, four individual panel sections would be provided. These panel sections 346 are provided so that they may be heat sealed to each other in order to form a rectangularly configured panel, equivalent to the panel 342, for heat sealing to the lower sheet 340.

In any event, the panels 346 are folded in such manner that they provide a first essentially vertically disposed wall 348 with an outwardly struck flange 350 heat sealed to the upper surface of the bottom sheet 340. In this case, it can be observed that the flange 350 is illustrated by means of the phantom lines in FIG. 26 of the drawings. Thereafter, the panels 346 are heat sealed at their transverse edges in order to form the rectangularly configured panel 342 and are folded over to form an inclined wall 352. This inclined wall 352 which extends inwardly of the vertically disposed wall 348 is similarly provided with an inwardly struck, horizontally disposed peripherally extending flange 354. This latter flange 354 is also heat sealed to the bottom wall 340, in the manner as illustrated in FIG. 28, to thereby form the material containing chamber 344. In this way, it can be observed that four individual panel sections, as for example, those panel sections 346, can be utilized in order to form the peripherally extending material containing chamber 344 as illustrated in FIG. 28 of the drawings.

In place of using the four individual panel sections 346, it is possible to use an individual panel section 356, illustrated in FIG. 29, and which is provided with a plurality of spaced apart, triangularly shaped notches 358. A portion of the panel 356 may be folded over along a fold line 360 illustrated by phantom lines in order to form the corner margins and the flanges which are secured to the lower sheet 340. In this way, the individual panel 356, as illustrated in FIG. 29, can function in the same manner as the four discrete panel sections 346 illustrated in FIG. 26 in order to form the material containing chamber.

After formation of the internal material containing chamber, a top sheet can be secured to the lower sheet 340 through upwardly and downwardly struck flanges to form the peripherally extending side wall section to form the liquid chamber which is surrounded by the material containing chamber.

While the method of making the water bed mattresses of FIGS. 1–11 and FIG. 12 have been illustrated and described in more detail, it should be observed that the remaining water bed mattress constructions can also be made in like manner. Moreover, the method of making these water bed mattresses has actually been described in connection with the water bed mattresses per se.

Thus, there has been illustrated and described various forms of novel mattress constructions, as well as methods for making the same, and which mattress constructions can be made at a relatively low cost and used in a wide variety of applications. Consequently, the mattress constructions described herein and the methods of making the same fulfill all the objects and advantages sought therefor. Many changes, modifications, variations and other uses and applications of water bed mattress constructions and the method of making the same will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. A mattress construction for supporting an individual in an inclined position, said mattress construction comprising:

(a) an upper sheet and a lower sheet connected by a peripheral side wall to form an internal liquid chamber.

(b) openable and closable valve means in said mattress communicating with said liquid chamber for filling said liquid chamber with liquid and removing liquid therefrom, said liquid chamber being filled with a liquid which includes a viscosity increasing agent or a weight reducing agent, (c) means forming a material chamber around the periphery of a portion of said liquid chamber and which is impervious to liquid in said liquid chamber and is not in fluid communication with said liquid chamber, said material chamber being filled with a gaseous or solid or semi-solid material, (d) said material chamber being located under a portion of the liquid in said liquid chamber and providing support at least to the entire peripheral portion of said liquid chamber, and (e) said material chamber being substantially less yieldable when filled with a material than said liquid chamber when filled with a liquid, said material chamber extending into a portion of the space normally occupied by said liquid chamber when filled so that the peripheral portion of said lower sheet is raised above the remaining portion of said lower sheet and said material chamber extends substantially above said lower sheet, such that the entire surface of said upper sheet is supported by liquid in said liquid chamber and that said material chamber provides continuous support peripherally by a material which is relatively less yieldable than the liquid in said liquid chamber.

2. The mattress construction of claim 1 further characterized in that said material containing chamber is filled with a lightweight celled-type material.

3. The mattress construction of claim 1 further characterized in that said material containing chamber is filled with a relatively solid material.

4. The mattress construction of claim 1 further characterized in that said peripheral side wall is urged in a configuration so that it inclines downwardly and inwardly when said material chamber and liquid chamber are filled.

5. A mattress construction for supporting an individual in an inclined position, said mattress construction comprising:

(a) an upper sheet and a lower sheet connected by a peripheral side wall to form an internal liquid chamber capable of being filled with a liquid, (b) means forming a somewhat cylindrically shaped tubular ring member, (c) said tubular ring member being substantially hollow to form a material chamber to receive a material substantially less yieldable than a liquid in said liquid chamber, said tubular ring member having a diametral size at least less than the vertical dimension of the peripheral side wall, (d) said tubular ring member capable of being located with respect to a peripheral portion of said lower sheet and said liquid chamber and extending into a portion of the space normally occupied by said liquid chamber when said liquid chamber is filled with a liquid and said ring member is filled with a material, such that the peripheral portion of said lower sheet is raised above the remaining portion of said lower sheet and said tubular ring member extends above said remaining portion of said lower sheet but below the upper sheet thereby providing support to the entire peripheral portion of said liquid chamber, (e) and connecting means for connecting said tubular ring member to at least one of said peripheral side wall or said lower sheet on the exterior thereof.

6. The mattress construction of claim 5 further characterized in that said tubular ring member has a diametral size which is substantially less than the vertical dimension of said side wall when said chambers are filled.

7. The mattress construction of claim 5 further characterized in that said tubular ring member has a diametral size which is less than but almost equal to the vertical dimension of said side wall when said chambers are filled.

8. The mattress construction of claim 5 further characterized in that said material chamber compresses said liquid chamber when said chambers are filled respectively with material and liquid so that the entire peripheral portion of said lower sheet is located substantially above the remaining portion of said lower sheet but where said liquid chamber is substantially contiguous with the entire surface area of said upper sheet.

9. The mattress construction of claim 5 further characterized in that said peripheral side wall is urged in a configuration so that it inclines downwardly inwardly when said material chamber and liquid chamber are filled.

10. The mattress construction of claim 5 further characterized in that said material containing chamber is filled with a relatively solid material having a specific weight which is substantially less than the specific weight of the liquid introduceable into said liquid chamber.

11. The mattress construction of claim 5 further characterized in that said connecting means comprises an annular strip.

12. The mattress construction of claim 5 further characterized in that additional connecting means connects said tubular member to said lower sheet.

13. A mattress construction for supporting an individual in an inclined position and including a liquid chamber and a material containing chamber, said mattress construction comprising:

(a) first chamber forming means forming on upper liquid containing chamber, said first chamber forming means comprising:
  (1) a first upper sheet
  (2) a first lower sheet
  (3) a first peripherally extending side wall connecting said first upper and lower sheets,
  (4) said first peripherally extending side wall having an upwardly and downwardly struck portion connected to said first lower sheet when said chambers are both filled, and (b) second chamber forming means forming a lower material containing chamber, said second chamber forming means comprising:
  (1) a second upper sheet disposed beneath said first lower sheet and a portion of the inwardly and downwardly struck portion of said first side wall,
  (2) a second lower sheet,
  (3) a second peripherally extending side wall connecting said second upper and lower sheets, and
  (4) said second peripherally extending side wall having a portion merging into said second upper sheet at a point in proximity to the outer periphery of said liquid chamber.

14. The mattress construction of claim 13 further characterized in that said material containing chamber has an enlarged peripherally extending portion which surrounds said liquid chamber and that the depth of the liquid chamber around its periphery is relatively small with respect to the wall depth of the mattress construction.

15. The mattress construction of claim 13 further characterized in that said material containing chamber being substantially less yieldable when filled with a material than said liquid chamber when filled with a liquid so that said material chamber extends substantially above said lower sheet such that the entire surface of said first upper sheet is supported by liquid in said liquid chamber and that said material material chamber provides continuous peripheral support to the liquid chamber by a material which is relatively less yieldable than the liquid in said liquid chamber.

16. A mattress construction for supporting an individual in an inclined position, said mattress construction comprising:

(a) an upper sheet and a lower sheet connected by a peripheral side wall to form an internal chamber, (b) a first interior panel extending between at least peripheral portions of said upper sheet or said side wall, (c) said first interior panel having a portion substantially parallel to said upper and lower sheets dividing the internal chamber into a first liquid chamber and a second liquid chamber, (d) a second interior panel exterior between said first interior panel and either said lower sheet or said side wall somewhat in proximity to said lower sheet further dividing said interior chamber into a material chamber, said first and second panels being impervious to liquid in said liquid chambers and material in said material chamber and where said liquid chambers are not in fluid communication with said material chamber, said second interior panel extending in such manner that said material chamber is located under a portion of said first liquid chamber and providing support to the entire peripheral portion of said first liquid chamber.

17. The mattress construction of claim 16 further characterized in that said liquid chambers are water chambers and that said material chamber is an air chamber.

18. The mattress construction of claim 16 further characterized in that said first and second liquid chambers are in fluid communication with each other through an opening in at least said first interior panel.

19. The mattress construction of claim 16 further characterized in that said first and second liquid chambers are not in fluid communication with each other.

20. The mattress construction of claim 16 further characterized in that said first interior panel is connected to said side wall and extends generally in a direction substantially parallel to said upper and lower sheets, and that said second interior panel has a substantially vertically disposed portion.

21. The mattress construction of claim 16 further characterized in that said second interior panel has a lower portion sealed to said side wall near said lower sheet.

22. The mattress construction of claim 16 further characterized in that said second interior panel has a lower portion connected to said lower sheet.

23. The mattress construction of claim 16 further characterized in that said first interior panel is integral with said upper sheet and said second interior panel is integral with said lower sheet.

24. A mattress construction for supporting an individual in an inclined position, said mattress construction comprising:

(a) an upper sheet and a lower sheet connected by a peripheral side wall to form an internal liquid chamber.

(b) an interior material chamber forming means within said liquid chamber and having a first peripherally extending flange sealed to said lower sheet on said side wall near the lower portion thereof and a second peripherally extending flange sealed to said lower sheet inwardly of said first flange, said interior chamber forming means creating a material chamber which is impervious to liquid in said liquid chamber and is not in fluid communication with said liquid chamber, (c) said first flange being sealed to said lower sheet and said second flange being sealed to said lower sheet or said side wall somewhat in proximity to the periphery of said lower sheet so that said material chamber is located in close proximity to said side wall under a portion of said liquid chamber and providing support to the entire peripheral portion of said liquid chamber.

25. The mattress construction of claim 24 further characterized in that said material chamber being substantially less yieldable when filled with a material than said liquid chamber when filled with a liquid so that said material chamber extends substantially above said lower sheet such that the entire surface of said upper sheet is supported by liquid in said liquid chamber and that said material chamber provides continuous peripheral support by a material which is relatively less yieldable than the liquid in said liquid chamber.

26. The mattress construction of claim 25 further characterized in that said material chamber is an air chamber and said liquid chamber is a water chamber.

27. A mattress construction for supporting an individual in an inclined position, said mattress construction comprising:

(a) an upper sheet and a lower sheet connected by a peripheral side wall to form an internal liquid chamber, (b) an interior tube means located in said liquid chamber, (c) an outwardly extending first flange on said tube means and which flange is sealed to said lower sheet or said side wall in proximity to the lower portion thereof, (d) an outwardly extending second flange on said tube means and sealed to said lower sheet, forming a material chamber which is impervious to liquid in said liquid chamber and is not in fluid communication with said liquid chamber and having an overall height which is less than that of the liquid chamber when filled, (e) said first flange being sealed to said lower sheet somewhat in proximity to the periphery of said lower sheet and said side wall and said second flange being sealed to said lower sheet in spaced apart relation to but in proximity to said first flange so that said material chamber is located under a portion of said liquid chamber along the periphery thereof and provides support to the entire peripheral portion of said liquid chamber.

28. The mattress construction of claim 27 further characterized in that said second flange is sealed to said lower sheet and said first flange being sealed to the lower portion of said side wall so that said tube means is retained in the region where said side wall and lower sheet are connected.

29. The mattress construction of claim 28 further characterized in that said tube means is formed from a sheet which is folded over to create a tube and with the free margins extending outwardly to form said first and second flanges.

30. The mattress construction of claim 27 further characterized in that said first flange is sealed to said lower sheet and said second flange being sealed to said lower sheet in spaced apart relationship to said first sheet.

31. A mattress construction for supporting an individual in an inclined position, said mattress construction comprising:

(a) an upper sheet and a lower sheet connected by a peripheral side wall to form an internal liquid chamber, (b) means forming a material chamber which is impervious to liquid in said liquid chamber and is not in fluid communication with said liquid chamber.

(c) said material chamber being located under the entire liquid chamber and contigious with the lower sheet thereof and providing support to the entire liquid chamber, (d) said material chamber being substantially less yieldable when filled with a material than said liquid chamber when filled with a liquid so that said material chamber extends substantially above said lower sheet such that the entire surface of said upper sheet is supported by liquid in said liquid chamber and that said material chamber provides continuous support at least peripherally by a material which is relatively less yeildable than the liquid in said liquid chamber.

32. The mattress construction of claim 31 further characterized in that said material chamber is an air chamber and said liquid chamber is a water chamber.

* * * * *